US011359857B2

(12) United States Patent
Hunter et al.

(10) Patent No.: US 11,359,857 B2
(45) Date of Patent: Jun. 14, 2022

(54) APPLIANCE ENCAPSULATION MEMBER

(71) Applicant: WHIRLPOOL CORPORATION, Benton Harbor, MI (US)

(72) Inventors: Lynne F. Hunter, Dorr, MI (US); Daniel Lottinville, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/764,941

(22) PCT Filed: Nov. 20, 2017

(86) PCT No.: PCT/US2017/062556
§ 371 (c)(1),
(2) Date: May 18, 2020

(87) PCT Pub. No.: WO2019/099048
PCT Pub. Date: May 23, 2019

(65) Prior Publication Data

US 2020/0348073 A1 Nov. 5, 2020

(51) Int. Cl.
*F25D 23/06* (2006.01)
*F25D 23/02* (2006.01)

(52) U.S. Cl.
CPC ..... *F25D 23/065* (2013.01); *F25D 23/028* (2013.01); *F25D 2201/14* (2013.01); *F25D 2323/024* (2013.01)

(58) Field of Classification Search
CPC .... F25D 23/065; F25D 23/064; F25D 23/066; F25D 23/067; F25D 23/062; F25D 2323/024; F25D 2400/06; F25D 23/063; F25D 2400/04; F25D 23/069; F25D 23/028; F25D 2201/14; F25D 23/085; E05Y 2900/31
See application file for complete search history.

(56) References Cited

U.S. PATENT DOCUMENTS 2,873,041 A * 2/1959 Allen ..... F25D 23/085 220/592.06
4,170,391 A * 10/1979 Bottger ..... E05D 3/04 248/222.11

(Continued)

FOREIGN PATENT DOCUMENTS

WO 2007023445 A1 3/2007
WO 2009131295 A2 10/2009

*Primary Examiner* — Hiwot E Tefera
(74) *Attorney, Agent, or Firm* — Price Heneveld LLP

(57) ABSTRACT

A cabinet structure is provided herein that includes an exterior wrapper defining an opening and at least one liner disposed inside the opening of the wrapper with a front edge of the wrapper disposed laterally outward relative to a front edge of the liner. An insulation cavity is disposed between the wrapper and the liner. A trim breaker is coupled to the exterior wrapper and the liner. A hinge bracket is disposed outwardly of the trim breaker. A hinge support has a first portion disposed along the trim breaker and a second portion extending rearwardly from the first portion. An encapsulation member is disposed rearwardly of the trim breaker and defines an encapsulation cavity that is separated from the insulation cavity.

7 Claims, 10 Drawing Sheets

(56) References Cited

U.S. PATENT DOCUMENTS

| | | | | | |
|---|---|---|---|---|---|
| 4,550,576 | A * | 11/1985 | Tate, Jr | F25D 23/069 | 62/441 |
| 4,557,537 | A * | 12/1985 | Greer | H01R 4/64 | 29/256 |
| 4,558,503 | A * | 12/1985 | Wilson | B23P 15/26 | 29/446 |
| 4,606,112 | A * | 8/1986 | Jenkins | F25D 23/062 | 29/464 |
| 4,632,470 | A * | 12/1986 | Jenkins | F25D 23/062 | 29/525.12 |
| 4,706,363 | A * | 11/1987 | Taylor, Jr. | F25D 23/067 | 29/453 |
| 4,955,676 | A * | 9/1990 | Weaver | F25D 23/069 | 312/236 |
| 5,222,792 | A * | 6/1993 | Kai | E05D 15/502 | 312/406 |
| 5,720,536 | A * | 2/1998 | Jenkins | F25D 23/085 | 312/401 |
| 2004/0012315 | A1* | 1/2004 | Grace | F25D 23/062 | 312/406 |
| 2010/0263403 | A1 | 10/2010 | Choi | | |
| 2017/0184341 | A1* | 6/2017 | Grimm | F25D 21/04 | |
| 2019/0011174 | A1* | 1/2019 | Dherde | E05D 15/266 | |

* cited by examiner

APPLIANCE ENCAPSULATION MEMBER

CROSS-REFERENCE TO RELATED APPLICATIONS

This application is a National Stage Application under 35 U.S.C. § 371 of PCT Application No. PCT/US2017/062556, filed on Nov. 20, 2017, entitled "APPLIANCE ENCAPSULATION MEMBER," the entire disclosure of which is hereby incorporated herein by reference.

BACKGROUND

The present device generally relates to insulated structures, in particular, to a vacuum insulated refrigerator cabinet that includes a door hinge bracket coupled thereto.

SUMMARY

In at least one aspect, a cabinet structure is disclosed. The cabinet structure includes an exterior wrapper defining an opening. At least one liner is disposed inside the opening of the wrapper with a front edge of the wrapper disposed laterally outward relative to a front edge of the liner. An insulation cavity is disposed between the wrapper and the liner. A trim breaker is coupled to the exterior wrapper and the liner. A hinge bracket is disposed outwardly of the trim breaker. A hinge support has a first portion disposed along the trim breaker and a second portion extending rearwardly from the first portion. An encapsulation member is disposed rearwardly of the trim breaker and defines an encapsulation cavity that is separated from the insulation cavity.

In at least another aspect, a cabinet structure is disclosed. The cabinet structure includes a wrapper spaced apart from a liner. A trim breaker is coupled to the exterior wrapper and the liner. An insulation cavity is disposed between the wrapper, the liner, and the trim breaker. An encapsulation member is disposed rearwardly of the trim breaker and defining an encapsulation cavity that is separated from the insulation cavity.

In yet another aspect, a method of making a cabinet structure is disclosed. The method includes forming a wrapper having an opening. Next, a liner is positioned within the wrapper in a spaced apart orientation to define an insulation cavity therebetween. An encapsulation member is coupled to the wrapper. Lastly, a trim breaker is coupled to the wrapper, the first and second liners, and the encapsulation member thereby forming an insulation cavity and an encapsulation cavity.

These and other features, advantages, and objects of the present device will be further understood and appreciated by those skilled in the art upon studying the following specification, claims, and appended drawings.

DETAILED DESCRIPTION OF EMBODIMENTS

Figure 1:
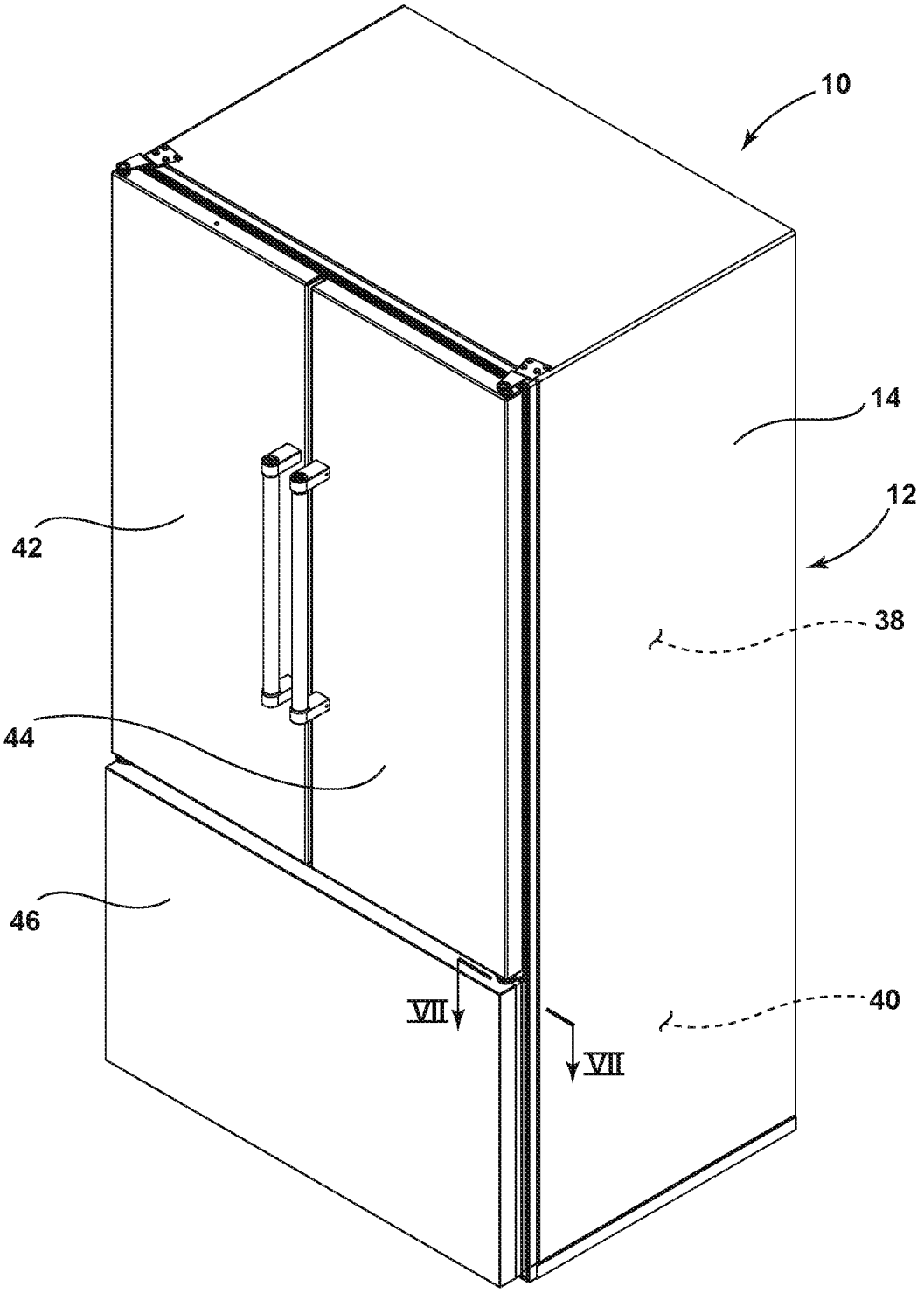
FIG. 1 is an isometric view of a refrigerator including an insulated cabinet structure, according to some examples.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-10, a refrigerator 10 has a cabinet structure 12 that includes a wrapper 14 defining an opening 16 and at least one liner 18, 20 disposed inside the opening 16 of the wrapper 14 with a front edge of the at least one liner 18, 20. An insulation cavity 22 is disposed between the wrapper 14 and the at least one liner 18, 20. A trim breaker 24 is coupled to the wrapper 14 and the at least one liner 18, 20. A hinge bracket 26 is disposed outwardly of the trim breaker 24. A hinge support 28 may have a first portion 30 disposed along the trim breaker 24 and a second portion 32 extending rearwardly from the first portion 30. An encapsulation member 34 is disposed rearwardly of the trim breaker 24 and defines an encapsulation cavity 36 that is separated from the insulation cavity 22.

Referring now to FIG. 1, the refrigerator 10 includes the insulated cabinet structure 12 that may define a refrigerator compartment 38 and/or a freezer compartment 40. Refrigerator compartment doors 42, 44 are provided to selectively provide access to the refrigerator compartment 38, while a freezer compartment door 46 is used to provide access to the freezer compartment 40. The insulated cabinet structure 12 is surrounded by the exterior wrapper 14 in assembly. The configuration of the refrigerator 10 is exemplary only and the present concept is contemplated for use in all refrigerator styles including, but not limited to, side-by-side refrigerators, whole refrigerator and freezers, and refrigerators with upper freezer compartments.

Figure 2:
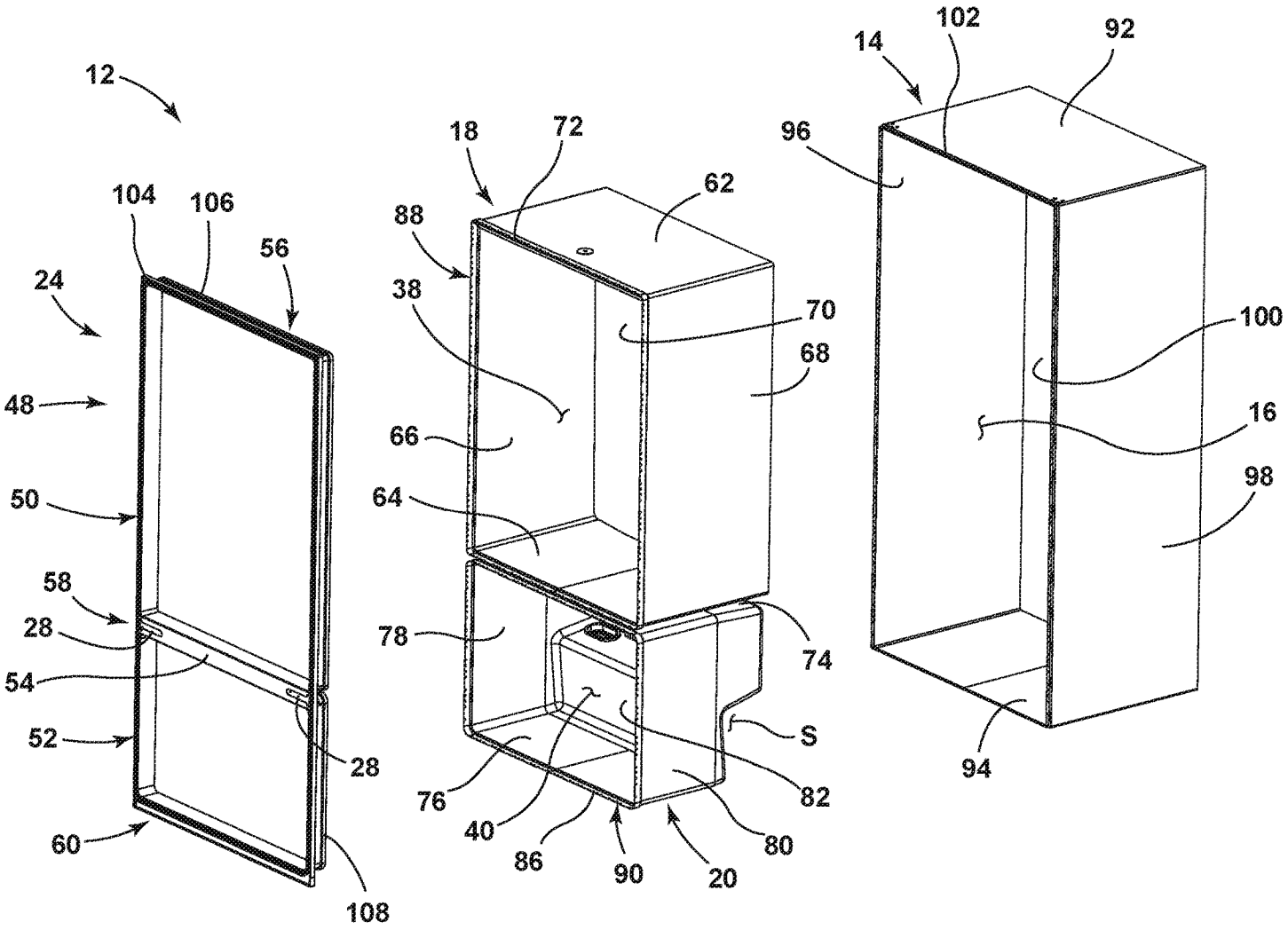
FIG. 2 is an exploded front perspective view of an insulated refrigerator cabinet structure, according to some examples.

With reference to FIG. 2, the insulated cabinet structure 12 generally includes the trim breaker 24 that includes a frame 48 defining an upper opening 50 and a lower opening 52 with a mullion portion 54 disposed therebetween. The trim breaker 24 includes an upper portion 56, a middle portion 58, and a lower portion 60. The insulated cabinet structure 12 further includes a refrigerator liner 18 having a top wall 62, bottom wall 64, opposed sidewalls 66, 68, and a rear wall 70 which cooperate to define the refrigerator compartment 38. The refrigerator liner 18 further includes a front edge 72 disposed on a front portion of the refrigerator compartment 38 along the top wall 62, the bottom wall 64 and the opposed sidewalls 66, 68.

Similarly, the freezer liner 20 includes a top wall 74, a bottom wall 76, opposed sidewalls 78, 80, and a rear wall 82, which all cooperate to define the freezer compartment 40. The rear wall 82 is a contoured rear wall that provides a spacing S for housing cooling components 84 (FIG. 9) for cooling the refrigerator compartment 38 and/or the freezer compartment 40. Such components 84 may include a compressor, a condenser, an expansion valve, an evaporator, a plurality of conduits, and other related components used for cooling the refrigerator and/or freezer compartments 78, 80. The freezer liner 20 further includes a front edge 86 disposed at a front portion of the freezer compartment 40 which is disposed along the top wall 74, the bottom wall 76 and the opposed sidewalls 66, 68. In assembly, the front edge 72 of the refrigerator liner 18 and the front edge 86 of the freezer liner 20 define first and second openings 88, 90 that are configured to couple with the inner coupling portion 106 disposed about the upper and lower openings 50, 52 of the trim breaker 24.

As further shown in FIG. 2, the insulated cabinet structure 12 further includes the exterior wrapper 14 which includes a top wall 92, a bottom wall 94, opposed sidewalls 96, 98, and a rear wall 100 which cooperate to define the opening 16. The wrapper 14 further includes a front edge 102 that defines a front portion of the opening 16. In assembly, the front edge 102 of the exterior wrapper 14 is coupled to the coupling portions 104, 106 of the trim breaker 24 around the liners 18, 20. Further, the refrigerator liner 18 and freezer liner 20 are received within the opening 16 of the exterior wrapper 14 when assembled, such that there is a spacing between the outer surfaces of the refrigerator liner 18 and the freezer liner 20 relative to the inner surfaces of the exterior wrapper 14. In this way, the spacing can be used to create the insulation cavity 22 that includes any desired type of insulation therein. For example, the insulation cavity 22 may be a vacuum insulated space and/or contain a vacuum insulated structure therein.

The wrapper 14 may be made from sheet metal, polymer materials, or other suitable materials. If the wrapper 14 is made from sheet metal, the wrapper 14 may be formed utilizing known steel-forming tools and processes. Additionally and/or alternatively, the wrapper 14 may be formed from a polymer and/or elastomer material. For example, the wrapper 14 may be fabricated by thermoforming a sheet of thermoplastic polymer material. The wrapper 14 may be constructed of a material that may be substantially impervious, such that oxygen, nitrogen, carbon dioxide, water vapor, and/or other atmospheric gases are sealed out of the insulation cavity 22 (FIG. 5) that is formed between the wrapper 14 and liners 18, 20. If the wrapper 14 is formed from a polymer material, the polymer material may include a plurality of layers, wherein the layers of material are selected to provide impermeability to various gases.

The refrigerator liner 18 and the freezer liner 20 may be made from a sheet metal material utilizing known steel-forming tools and processes. Additionally and/or alternatively, the liners 18, 20 may otherwise be formed from a polymer and/or elastomer material in the form of a polymer sheet that is thermoformed. The polymer material may include one or more layers of material that are selected to provide impermeability to gases. The liners 18, 20 may optionally include a plurality of reinforcing structures, such as vertically spaced ridges or other forms for supporting dividers within the refrigerator compartment 38 or freezer compartment 40. Examples of layered polymer materials that may be utilized to construct the wrapper 14 or liners 18, 20 are disclosed in U.S. patent application Ser. No. 14/980,702, now U.S. Pat. No. 10,610,985, entitled "MULTI-LAYER BARRIER MATERIALS WITH PVD OR PLASMA COATING FOR VACUUM INSULATED STRUCTURE," and U.S. patent application Ser. No. 14/980,778, now U.S. Pat. No. 10,018,406, entitled "MULTI-LAYER GAS BARRIER MATERIALS FOR VACUUM INSULATED STRUCTURE," the entire contents of which are incorporated herein by reference. In some instances, the wrapper 14 and/or the liners 18, 20 may be thermoformed from a tri-layer sheet of polymer material including first and second outer structure layers and a central barrier layer that is disposed between the outer layers. The outer layers and the barrier layer may be formed from thermoplastic polymers. The barrier layer may optionally include an elastomeric material. The outer layers and the barrier layer may be coextruded or laminated together to form a single multi-layer sheet prior to thermoforming.

When the insulated cabinet structure 12 is assembled, the trim breaker 24 connects to the front edge 102 of the wrapper 14, to the front edge 72 of the refrigerator liner 18, and to the front edge 86 of the freezer liner 20 to thereby interconnect the wrapper 14 and the liners 18, 20 into a composite structure. The trim breaker 24 may be formed from a suitable material that is substantially impervious to gases to maintain a vacuum in the insulation cavity 22, and also having a low coefficient of thermal conductivity to reduce or prevent the transfer of heat between the wrapper 14 and the liners 18, 20. In various examples, the trim breaker 24 may be formed utilizing a molding process, and specifically, may include a reaction injection molding (RIM) process. In a RIM process, the trim breaker 24 is formed in a mold using a polyurethane material. Other materials suitable for a RIM process may include, but are not limited to, polyureas, polyisocyanurates, polyesters, polyphenols, polyepoxides, thermoplastic elastomers, polycarbonate, and nylon materials. In some examples, the trim breaker 24 is overmolded to the refrigerator liner 18, the freezer liner 20 and the wrapper 14. In this way, the insulated cabinet structure 12 can be a unitary part after the trim breaker 24 is cast onto the liners 18, 20 and the wrapper 14.

When the refrigerator 10 (FIG. 1) is in use, the wrapper 14 is typically exposed to ambient room temperature air, whereas the liners 18, 20 are generally exposed to refrigerated air in the refrigerator compartment 38 or the freezer compartment 40. With the trim breaker 24 being made of a material that is minimally conductive, and/or substantially non-conductive, with respect to heat, the trim breaker 24 reduces the transfer of heat from the wrapper 14 to the liners 18, 20.

The trim breaker 24 may include linear portions that are interconnected to form a ring-like structure having an outer coupling portion 104 and an inner coupling portion 106. The inner coupling portion 106 defines the upper and lower openings 50, 52 that generally correspond to the openings 88, 90 defined by the refrigerator liner 18 and the freezer liner 20 of the cabinet structure 12. It will be understood that the trim breaker 24 may have various shapes and configurations as may be required for a particular application, and it is further contemplated that the trim breaker 24 can be used in a refrigerator 10 having multiple liners (as shown in FIG. 2 with a refrigerator liner 18 and a freezer liner 20) or in a refrigerator 10 having a single liner for use as a refrigerator or freezer only.

Figure 3:
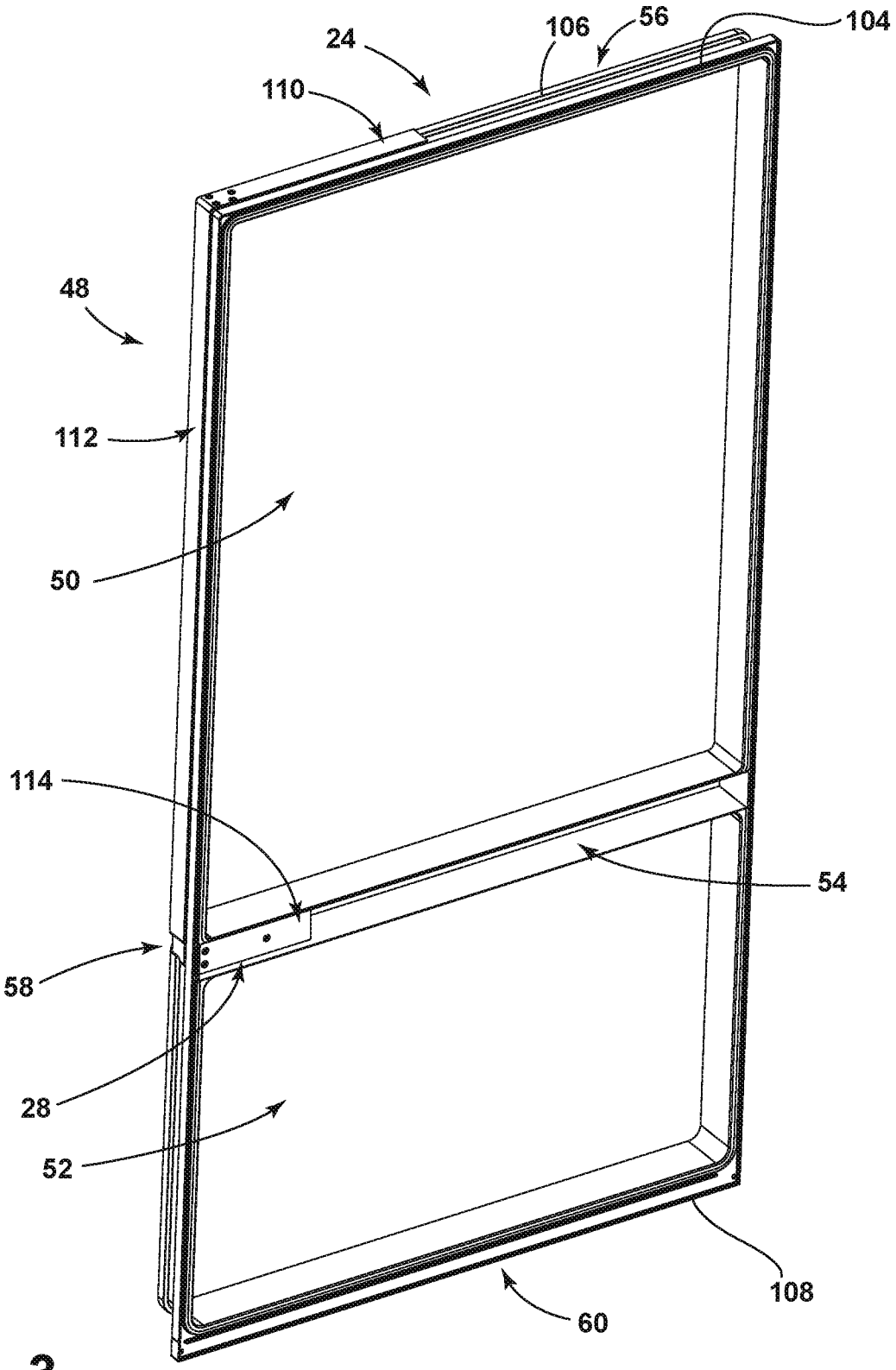
FIG. 3 is a front perspective view of a trim breaker and a hinge bracket, according to some examples.
Figure 4:
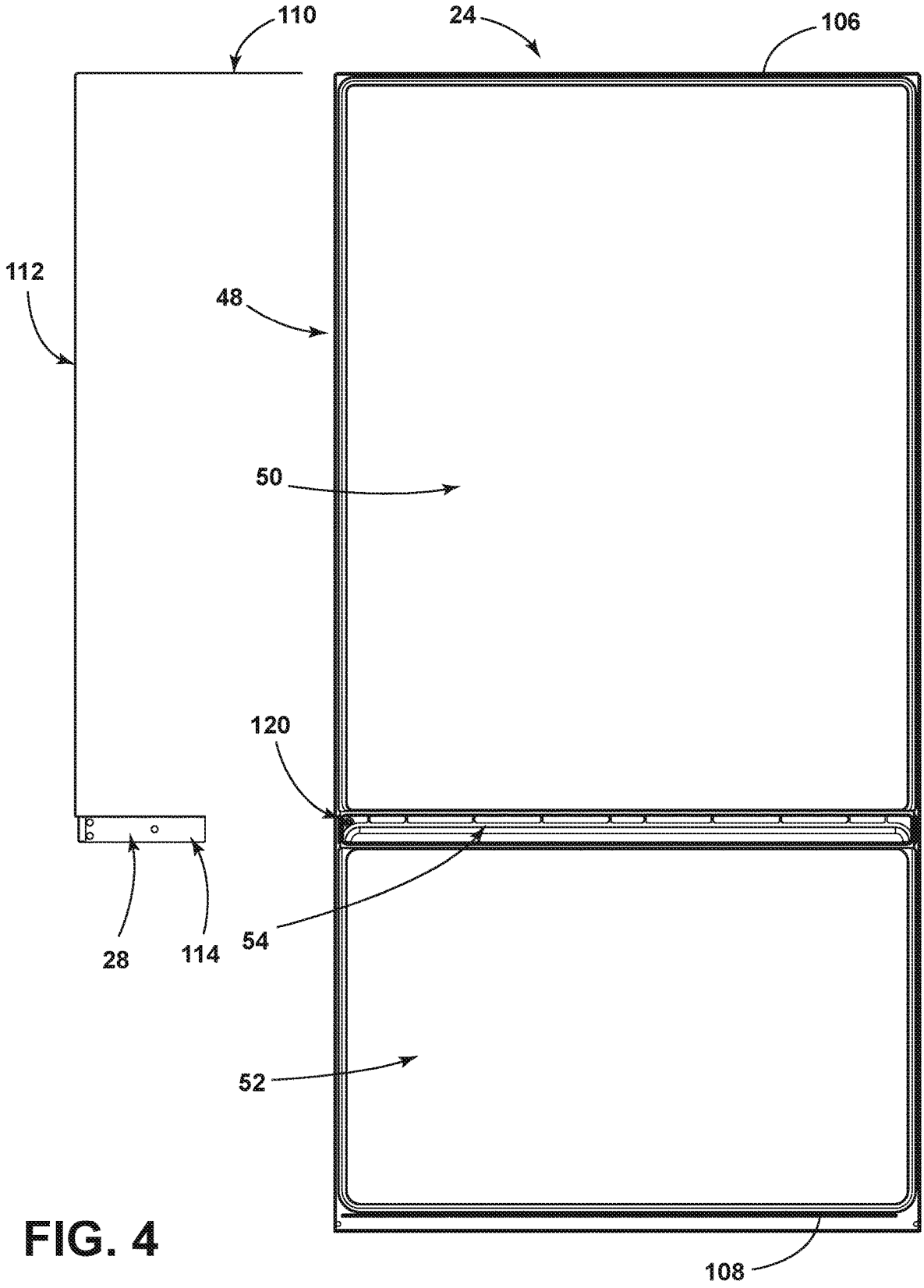
FIG. 4 is a front plan view of the trim breaker and the hinge bracket, according to some examples.

Referring now to FIGS. 3 and 4, the hinge support 28 may be disposed around a portion of the trim breaker 24. In some instances, the hinge support 28 includes an upper frame portion 110, a central frame portion 112, and/or a lower frame portion 114. An upper hinge support 28 is disposed on the upper frame portion 110. A lower hinge support 28 is disposed on the lower frame portion 114. The upper and lower hinge supports 28 are coupled with the hinge brackets 26 and receive downward forces 46, rotational forces, torsion, shear stresses, etc. exerted by the doors 42, 44, 46 onto the cabinet 10. The upper and lower hinge supports 28 may transfer these downward forces, rotational forces, and/or torsion to the central frame portion 112 and/or any other portion of the hinge support 28 or the cabinet structure 12.

With further reference to FIGS. 3 and 4, the support frame may be disposed outwardly of the trim breaker 24. In some cases, the upper hinge support 28 may be disposed between the outer coupling portion 104 and the upper coupling portion 106. The lower hinge support 28 may be disposed through an aperture 120 in the trim breaker 24 and/or forwardly of a mullion portion 54 of the trim breaker 24.

Figure 5:
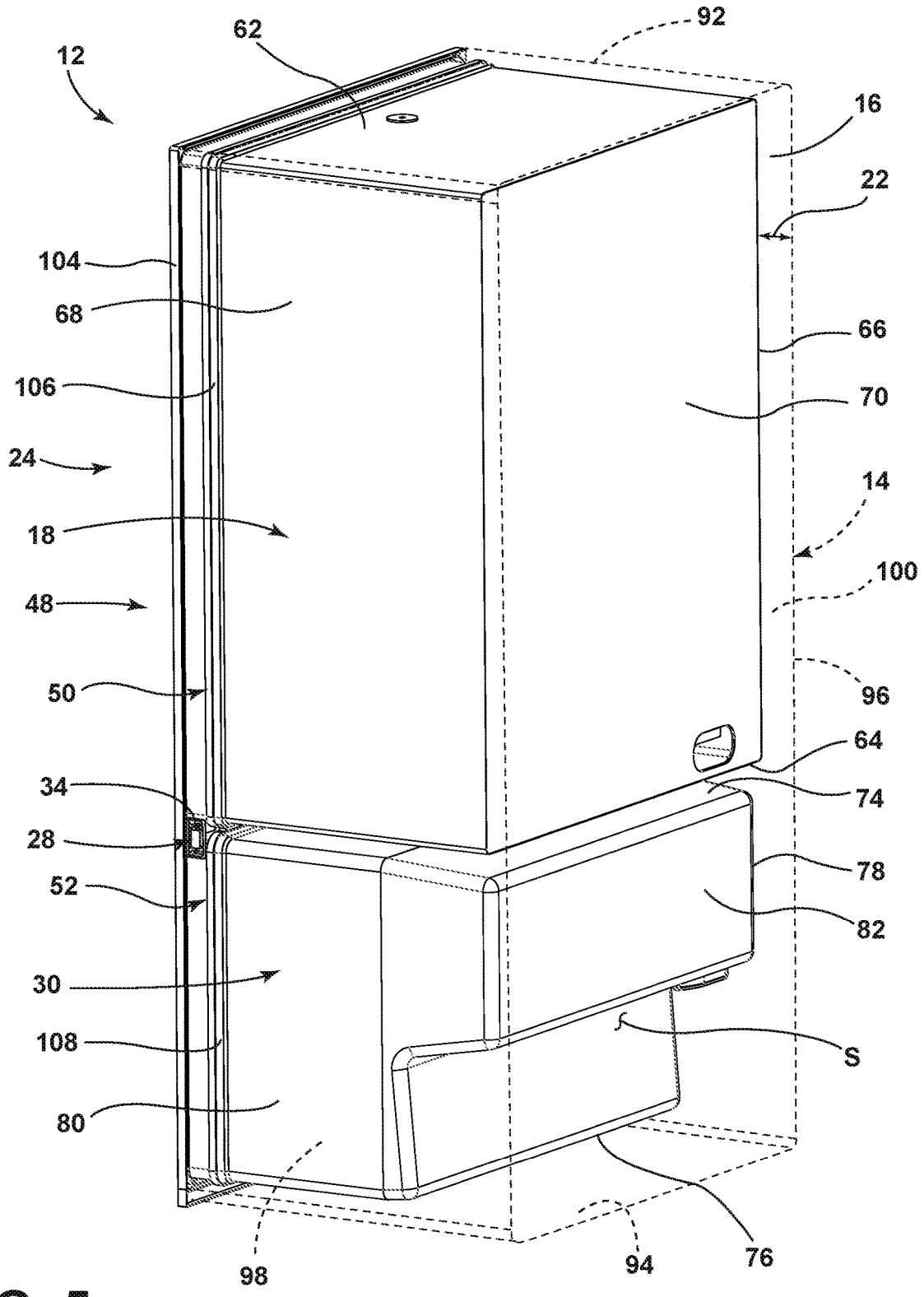
FIG. 5 is a rear isometric view of the insulated refrigerator cabinet structure of FIG. 2 as assembled.
Figure 6:
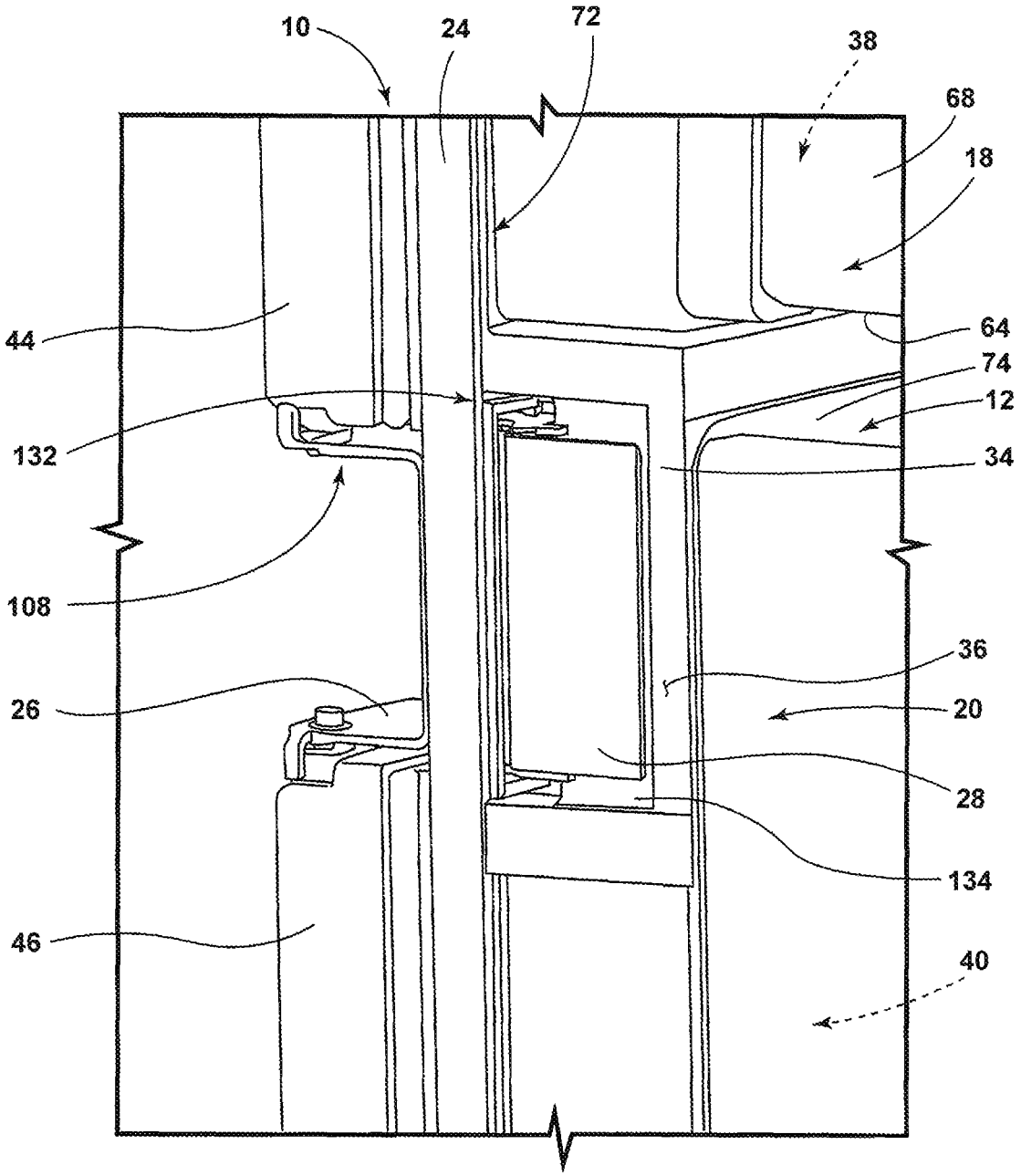
FIG. 6 is a side perspective view of the insulated refrigerator cabinet structure with the hinge bracket and an encapsulation member disposed on opposing sides of the trim breaker, according to some examples.

Referring to FIGS. 5 and 6, the front edge 72 of the refrigerator liner 18 includes linear portions disposed around the top wall 62, bottom wall 64 and opposed sidewalls 66, 68 at front portions thereof. The profile of the combination of the liners 18, 20 may be smaller than the profile of the wrapper 14 to thereby form the insulation cavity 22 (FIG. 5) within the spacing defined between the liners 18, 20 and the wrapper 14. The insulation cavity 22 is configured to receive an insulating material (not shown) that may be configured as a vacuum core material.

The vacuum core material may include a plurality of individual core panels that are preformed and positioned between the wrapper 14 and the liners 18, 20. Alternatively, the vacuum core material may include silica powder or other suitable loose filler material that is inserted (e.g. blown) into the insulation cavity 22 after the wrapper 14, the liners 18, 20, and the trim breaker 24 are formed into a unitary composite structure. In vacuum insulated structures, a vacuum within the insulation cavity 22 decreases heat transmission through the insulation cavity 22. By creating a vacuum between the spaces intended to be thermally isolated, heat conduction is minimized because there is no, or less, material (e.g., air) to transfer the thermal energy between the thermally isolated spaces. In some instances, the insulation cavity 22 may have an air pressure of less than about 1 atm, about 0.5 atm, about 0.4 atm, about 0.3 atm, about 0.2 atm, about 0.1 atm, or less than about 0.01 atm.

Figure 7:
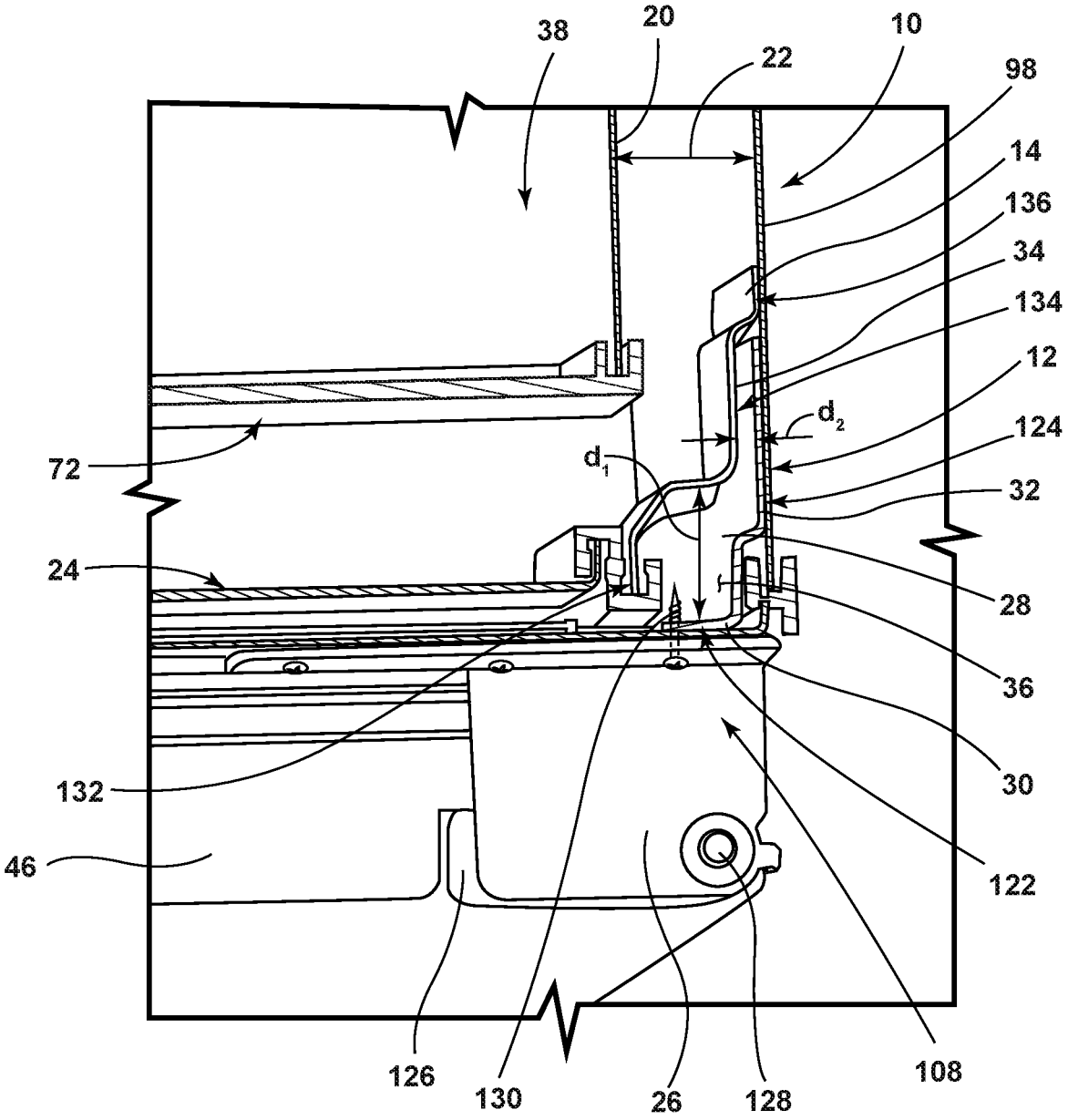
FIG. 7 is a cross-sectional view of the refrigerator cabinet of FIG. 1 taken along the line VII-VII.

Referring to FIGS. 5-7, as provided herein, the hinge support 28 may assist in supporting one or more hinges that are attached to the cabinet. In some instances, the hinge support 28 may be disposed between a portion of the trim breaker 24 and the refrigeration compartment 38 and/or freezer compartment 40. The hinge support 28 may have a first section 122 that extends in a parallel direction to an attachment portion of the hinge. A second section 124 may be offset, or oriented in an intersecting direction, from the first section 122. In some instances, the second section 124 may couple to or otherwise contact the wrapper 14 and/or the liners 18, 20 of the cabinet.

With further reference to FIGS. 5-7, the encapsulation member 34 is disposed around the hinge support 28. In various examples, the encapsulation member 34 may have any desired shape. For example, as illustrated, the encapsulation member 34 has a first portion 132 that is separated from the hinge support 28 by a first distance $d_1$ to accommodate a portion of the fastener 130 therein. A second portion 134 of the encapsulation member 34 may extend rearwardly along the side portion of the wrapper 14 in a direction that is parallel to the second section 124 of the hinge support 28. The second portion 134 may be disposed a second distance $d_2$ from the wrapper 14. A third portion 136 of the encapsulation member 34 may couple with the wrapper 14 at a position that is rearward of the hinge support 28. As provided herein, the encapsulation member 34 may define the encapsulation cavity 36 that is impervious to the insulation cavity 22 such that oxygen, nitrogen, carbon dioxide, water vapor, and/or other atmospheric gases are sealed out of the insulation cavity 22. Thus, the fastener 130 may be disposed within the encapsulation cavity 36 and the insulation structure, which is possibly a vacuum insulated structure, may maintain its integrity after insertion of the fastener 130.

The encapsulation member 34 may be made from a sheet metal material utilizing known steel-forming tools and processes. Additionally and/or alternatively, the encapsulation member 34 may otherwise be formed from a polymer and/or elastomer material in the form of a polymer sheet that is thermoformed. The polymer material may include one or more layers of material that are selected to provide impermeability to gases. The encapsulation member 34 may optionally include a plurality of reinforcing structures, such as vertically spaced ridges or other forms. Additionally, and/or alternatively, the encapsulation member 34 may be integrally formed within the trim breaker 24 and/or the wrapper 14.

Figure 8:
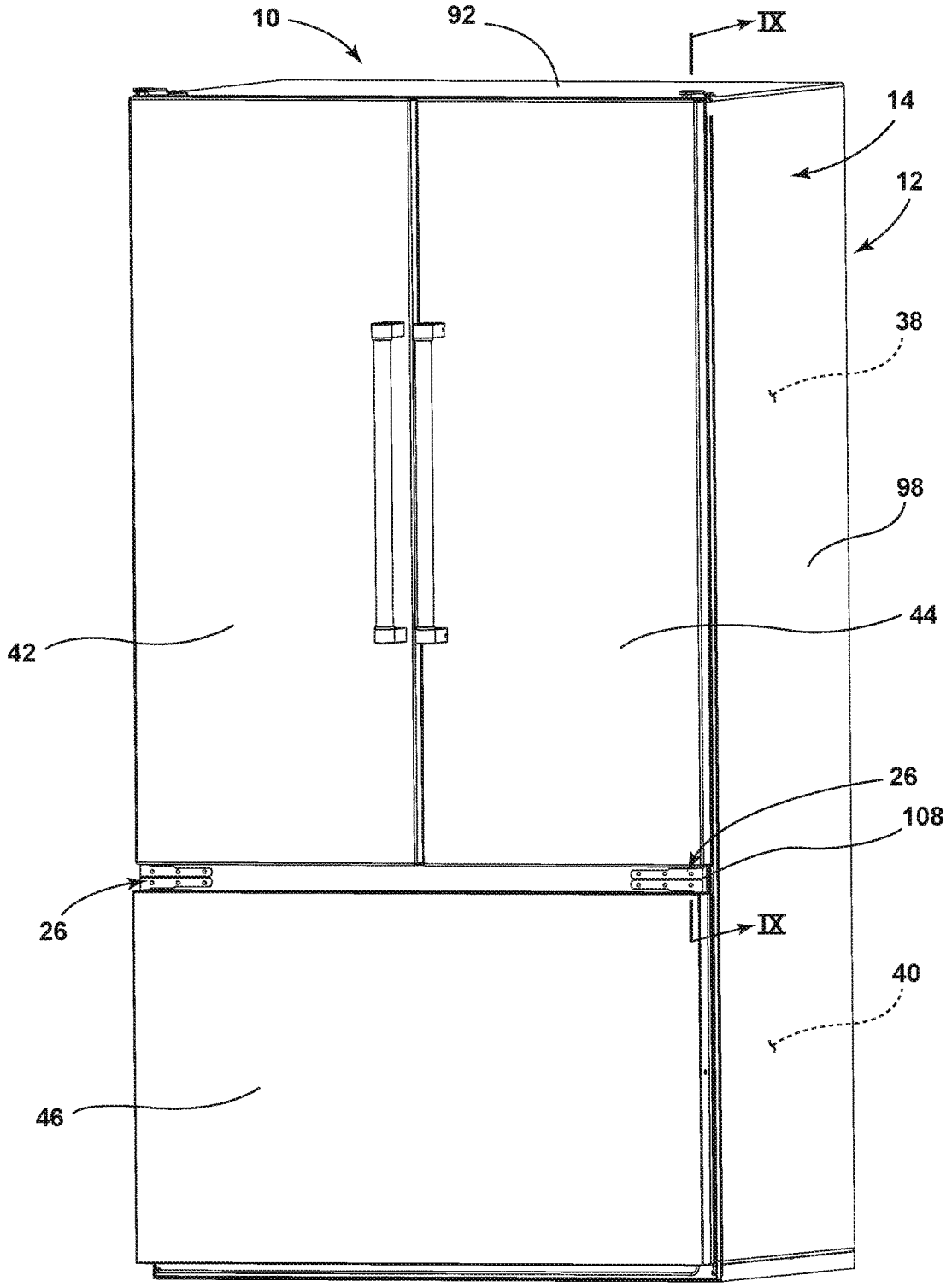
FIG. 8 is a front perspective view of the insulated refrigerator cabinet structure with a centrally disposed hinge bracket attached to the cabinet structure, according to some examples.
Figure 9:
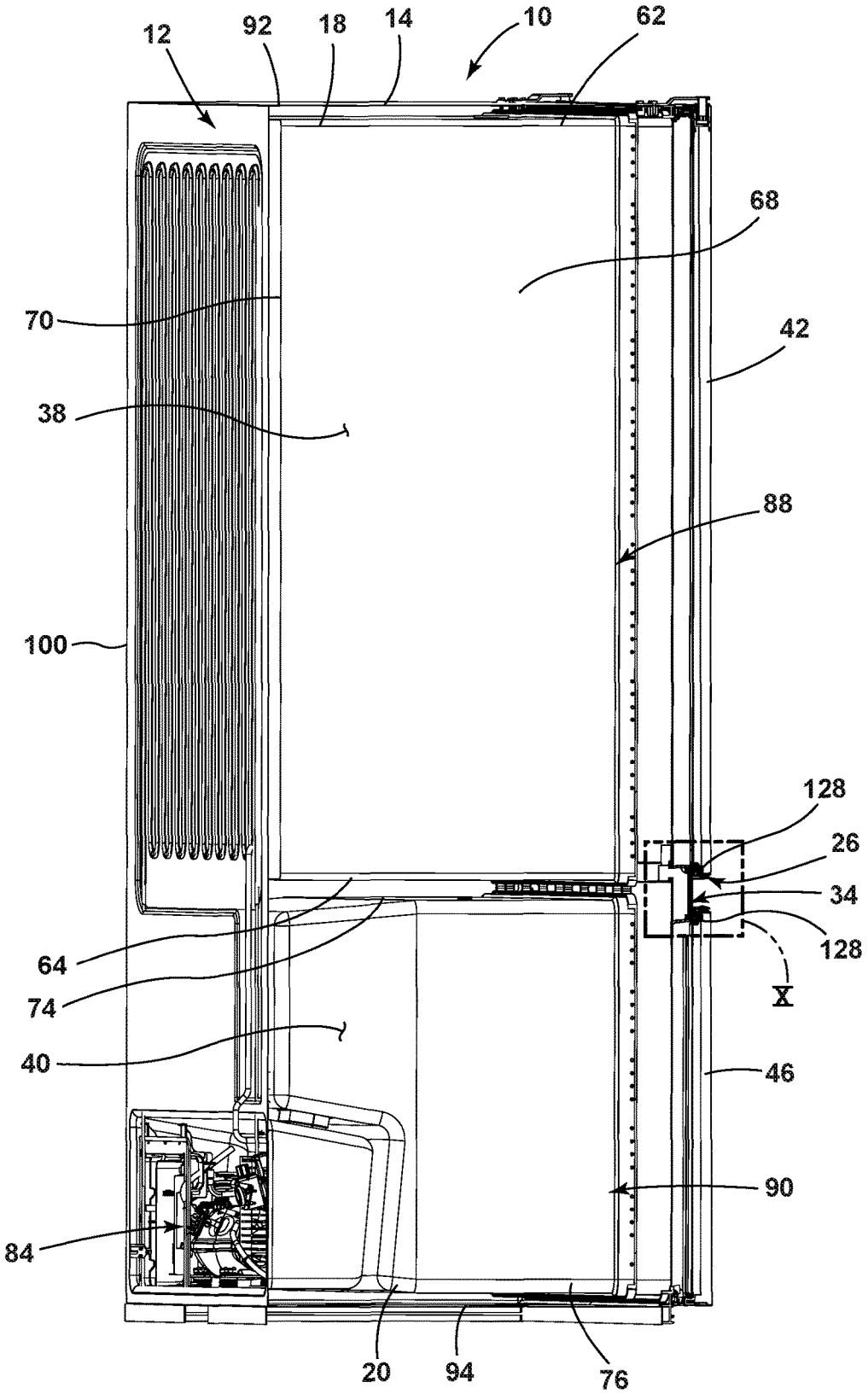
FIG. 9 is a cross-sectional view of the refrigerator cabinet of FIG. 8 taken along the line IX-IX.
Figure 10:
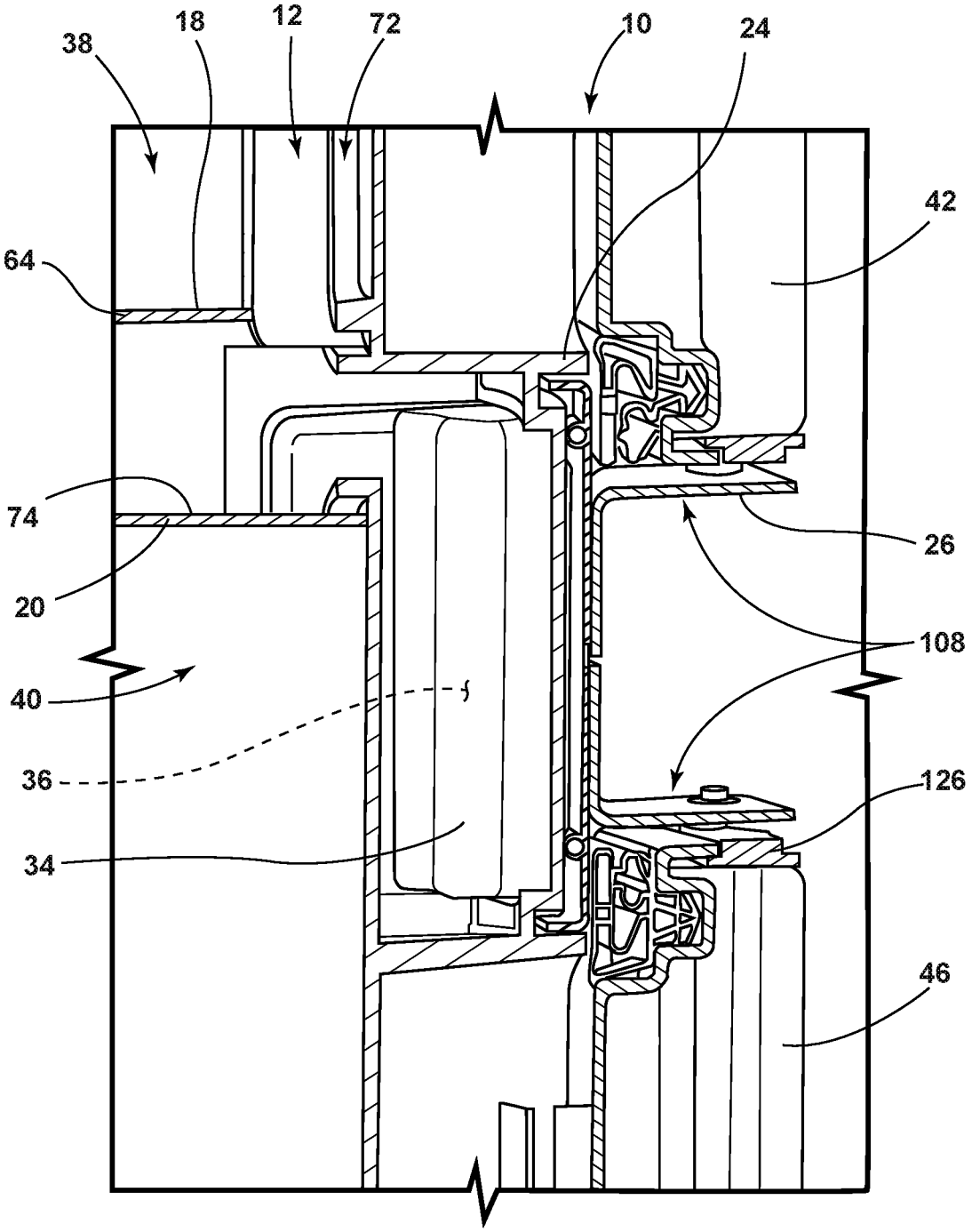
FIG. 10 is an enhanced view of area X of FIG. 9.

With reference to FIGS. 8-10, each door 42, 44, 46 may include a corresponding mounting block 126 and hinge pin 128 is disposed between the hinge bracket 26 and the mounting block 126. It is contemplated that the mounting blocks 126 may be welded to the door 42, 44, 46 or otherwise secured thereto. The hinge brackets 26 are coupled to the cabinet 12 using one or more mechanical fasteners 130 and/or through any other type of fastener 130 or adhesive known in the art. The hinge pins 128 are each disposed between a corresponding mounting block 126, and a corresponding hinge bracket 26. The resulting couplings may enable the entirety of the hinge pins 128 to be external to the door 42, 44, 46. Additionally, the hinge pins 128 may be free from having to be directly secured to the door 42, 44, 46. Such an arrangement may provide several advantages. For example, by locating the hinge pins 128 external to the door 42, 44, 46, there is no need to alter the door 42, 44, 46 to provide a recess or other accommodation for receiving the hinge pins 128. In embodiments where the door 42, 44, 46 is vacuum insulated, recesses or other accommodations formed in the door 42, 44, 46 may compromise the vacuum. Accordingly, the hinge assemblies 108 described herein aid in preserving the integrity of vacuum insulated structures and/or other insulative structures that may be disposed within the cabinet structure 12.

A variety of advantages may be derived from the use of the present disclosure. For example, the use of the hinge support provides assistance in transferring downward forces, rotational forces, and/or torsion forces provided by the door on the cabinet to the hinge support frame or cabinet. Moreover, the encapsulation member may assist in maintaining a desired insulative efficiency within an insulation cavity after one or more fasteners are inserted thereinto. The encapsulation member may be manufactured at low costs when compared to various solutions for maintaining a vacuum within the insulation cavity.

It will be understood by one having ordinary skill in the art that construction of the described invention and other components is not limited to any specific material. Other exemplary examples of the invention disclosed herein may be formed from a wide variety of materials unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components. Furthermore, it will be understood that a component preceding the term "of the" may be disposed at any practicable location (e.g., on, within, and/or externally disposed from the appliance) such that the component may function in any manner described herein.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A cabinet structure, comprising:

an exterior wrapper defining an opening;

at least one liner disposed inside the opening of the exterior wrapper with a front edge of the exterior wrapper disposed laterally outward relative to a front edge of the liner, wherein an insulation cavity is disposed between the exterior wrapper and the liner;

a trim breaker coupled to the exterior wrapper and the liner;

a hinge bracket disposed outwardly of the trim breaker;

a hinge support having a lower frame portion that includes a first portion disposed along the trim breaker and a second portion extending rearwardly from the first portion, the hinge support also including a central frame portion extending outwardly from the lower frame portion along a side of the trim breaker, wherein the hinge support is disposed forwardly of the trim breaker; and an encapsulation member at least partially disposed around the hinge support and disposed rearwardly of the trim breaker, wherein the encapsulation member and the hinge support define an encapsulation cavity that is separated from the insulation cavity.

2. The cabinet structure of claim 1, wherein the encapsulation member has a first portion that is separated from the hinge support by a first distance to accommodate a portion of a fastener therein.

3. The cabinet structure of claim 2, a second portion of the encapsulation member extends rearwardly along a side portion of the exterior wrapper in a direction that is parallel to the hinge support.

4. The cabinet structure of claim 1, further comprising:

a door having a mounting block thereon; and a hinge pin disposed between the hinge bracket and the mounting block.

5. The cabinet structure of claim 1, wherein the hinge support is disposed rearwardly of the trim breaker.

6. The cabinet structure of claim 1, wherein the encapsulation member is coupled to the trim breaker on a first portion thereof and to the exterior wrapper on a second portion thereof.

7. The cabinet structure of claim 1, wherein a portion of one or more fasteners is disposed within the encapsulation cavity.

* * * * *